US006148876A

United States Patent [19]

Corniani et al.

[11] Patent Number: 6,148,876

[45] Date of Patent: Nov. 21, 2000

[54] METHOD AND TANK FOR DISPENSING LIQUID SUBSTANCES INTO CONTAINERS

[75] Inventors: Carlo Corniani, Marmirolo; Narciso De Antoni Migliorati, Castiglione Delle Stiviere, both of Italy

[73] Assignee: Azionaria Costruzioni Macchine Automatiche A.C.M.A. S.p.A., Bologna, Italy

[21] Appl. No.: 09/359,768

[22] Filed: Jul. 22, 1999

[30] Foreign Application Priority Data

Jul. 24, 1998 [IT] Italy ..... BO98A0457

[51] Int. Cl.[7] ..... B65B 3/00

[52] U.S. Cl. ..... 141/84; 141/1; 141/65; 141/67; 141/145

[58] Field of Search ..... 141/1, 65, 67, 141/137, 144, 145, 84

[56] References Cited

U.S. PATENT DOCUMENTS

| | | | |
|---|---|---|---|
| 3,464,464 | 9/1969 | Laub | 141/145 |
| 4,499,931 | 2/1985 | Urban | 141/67 |
| 4,588,001 | 5/1986 | Leonard | 141/145 |
| 4,601,409 | 7/1986 | DiRegolo | 141/65 |
| 5,150,743 | 9/1992 | Walusiak | 141/144 |
| 5,156,193 | 10/1992 | Baruffato et al. | 141/1 |
| 5,168,905 | 12/1992 | Phallen | 141/1 |
| 5,522,438 | 6/1996 | Gustafsson et al. | 141/1 |
| 5,823,234 | 10/1998 | Boertz | 141/67 |
| 5,865,225 | 2/1999 | Weiss | 141/145 |

FOREIGN PATENT DOCUMENTS

| | | |
|---|---|---|
| 2 612 168 | 9/1988 | France . |
| 43 04 808 | 8/1994 | Germany . |

*Primary Examiner*—J. Casimer Jacyna
*Attorney, Agent, or Firm*—Pillsbury Madison & Sutro LLP

[57] ABSTRACT

Containers are directed onto a carousel rotatable as one about a vertical axis with a tank affording a fluid-tight enclosure and equipped with filler valves, each positionable over the mouth of a relative container; the tank is filled with a liquid substance until a given head has been established, whereupon the enclosure is negatively or positively pressurized, according to the type of liquid substance being handled, in such a way that the jet formed at the outlet of the filler valves will be dispensed at a selected discharge pressure different to the pressure deriving solely from the head of the liquid substance in the tank. The tank is depressurized when filled with foamable liquid substances, and pressurized when filled with viscous substances.

13 Claims, 2 Drawing Sheets

54
46
65
44
45
57
66
59
58
47
64
63
55
62
41
42
43
53
p2
p1
52
49
2
14
56
60
48
50
51
H
15
4
pt
pe
3
61
38
39
5
40
34
33
36
6
35
37
40
39
3
4
15

METHOD AND TANK FOR DISPENSING LIQUID SUBSTANCES INTO CONTAINERS

BACKGROUND OF THE INVENTION

The present invention relates to a method of dispensing liquid substances into containers.

The invention finds application to advantage in the field of machines for filling containers both with foamable liquids, typically liquid detergents, sparkling wines and the like, and with viscous fluids such as creamy liquid soaps, gels, oils and similar products: a field to which reference is made specifically in the present specification albeit implying no limitation in scope.

Filling machines of the general type referred to above consist substantially of a tank supported by a main carousel and holding a supply of the liquid substance; the carousel rotates about a vertical axis tangentially to a first transfer station, by way of which it receives a succession of containers each affording a filler mouth.

The tank is rigidly associated with the carousel and affords a plurality of filler valves at the bottom, each of which can be associated with the mouth of a respective container in such a manner that when the carousel is set in motion, the tank rotates about the vertical axis and its contents are dispensed by way of the filler valves into the containers, whereupon the filled containers are directed by way of a second transfer station onto an outfeed conveyor.

Conventionally, when such filling machines are utilized for foamable liquids, it is essential to minimize foaming both when the tank is filled and during the step of dispensing the liquid into each container. Furthermore, it is important to ensure that any foam happening to form and linger inside the tank can be eliminated in as short a time as possible.

With these same ends in view, it has been found advantageous to maintain an appreciable head of the selected substance in the tank, so that the height separating the free surface of the liquid from the outlet of the single filler valve will be as great as possible. In this way the mass of the liquid substance remains inside the tank for a relatively long duration, throughout the operation of filling the containers, and any foam that may have formed during the replenishment of the tank, especially on the surface of the liquid, is allowed a relatively long interval of time in which to dissolve all but completely and in a spontaneous manner before being transferred into the containers.

Conversely, the hydrostatic pressure generated on the bottom of the tank gravitationally by a sizable head of liquid is relatively high, and will produce a high discharge velocity through the outlet of the filler valve.

This high discharge velocity in turn causes the jet of liquid to be dispensed from the filler valve with greater force, occasioning a comparatively violent impact of the jet on the bottom of the respective container, and the formation of foam.

The way to prevent such a situation occurring would be to maintain a relatively small head of the liquid substance inside the tank, though this would contrast with the aforementioned need to promote a spontaneous dissolution of any foam, as a smaller head will shorten the duration for which the liquid remains in the tank and therefore reduce the time available for the foam to dissolve.

It has been found also that in cases where such filling machines are used for dispensing viscous substances, which by reason of their consistency will not flow as readily through the filler valves, a relatively large head needs to be maintained in the tank in such a manner that the mass of fluid bearing gravitationally on the bottom of the tank will generate a hydrostatic pressure sufficient to ensure a discharge pressure at the outlet of each filler valve of which the value is able in turn to ensure a relatively high rate of flow and therefore a suitably fast filling time per single container.

To this end it has been established by experiment that for viscous substances of heavier consistency, such as gels, it can happen that the weight of the head is insufficient to ensure the substance will be forced through the outlets of the filler valves at a reasonably high rate of flow. Accordingly, the expedient by which to obtain bigger heads and thus gravitationally increase the hydrostatic pressure on the bottom of the tank will be to use tanks of significantly greater dimensions and height, which disadvantageously require a lengthy and laborious cleaning operation at the end of the container filling cycle.

Whatever the case, the difficulty associated with making a viscous substance flow smoothly from the filler valves will become more noticeable when the tank begins to empty, as the level of the mass of viscous fluid in the tank subsides gradually to a value at which the gravity-related pressure value of the head is no longer sufficient to ensure that the substance will pass through the outlets of the filler valves at the required rate of flow.

Accordingly, the object of the invention is to provide a method of dispensing liquid substances into containers, such as will ensure that liquids having a relatively low viscosity can be handled without foaming either in the tank or internally of the single containers, and at the same time allow substances of higher viscosity, whatever the type, to be dispensed from the filler valve outlets at an acceptably fast rate of flow throughout the entire duration of the container filling cycle.

SUMMARY OF THE INVENTION

The stated object is duly realized according to the present invention in a method of dispensing liquid substances into containers having a filler mouth; the method disclosed comprises the steps of directing a liquid substance into a tank affording a fluid-tight enclosure and equipped with at least one filler valve positionable in alignment with and over the filler mouth of the container; filling the tank until the free surface of the liquid substance is separated from the filler valve by a head of predetermined height; dispensing a quantity of the liquid substance from the tank into the container by way of the filler valve; maintaining the filler mouth of the container in communication with the surrounding atmosphere; varying the pressure inside the tank and maintaining the tank at a pressure different to the atmospheric pressure registering at the filler mouth of the container.

The present invention also relates to a tank for dispensing liquid substances into containers with a filler mouth.

According to the invention, liquid substances are dispensed into containers from a tank comprising feed means by which a liquid substance is supplied, and at least one filler valve located at the bottom of the tank such as can be associated with each container to be filled while leaving the relative filler mouth open to the surrounding atmosphere.

The tank is filled by the feed means until the free surface of the liquid substance is separated from the filler valve by a head of predetermined height, and incorporates pressure variation means designed in such a way that the pressure within a fluid-tight enclosure afforded by the tank can be varied to obtain a value different to that of the atmospheric pressure registering at the filler mouth of the container.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
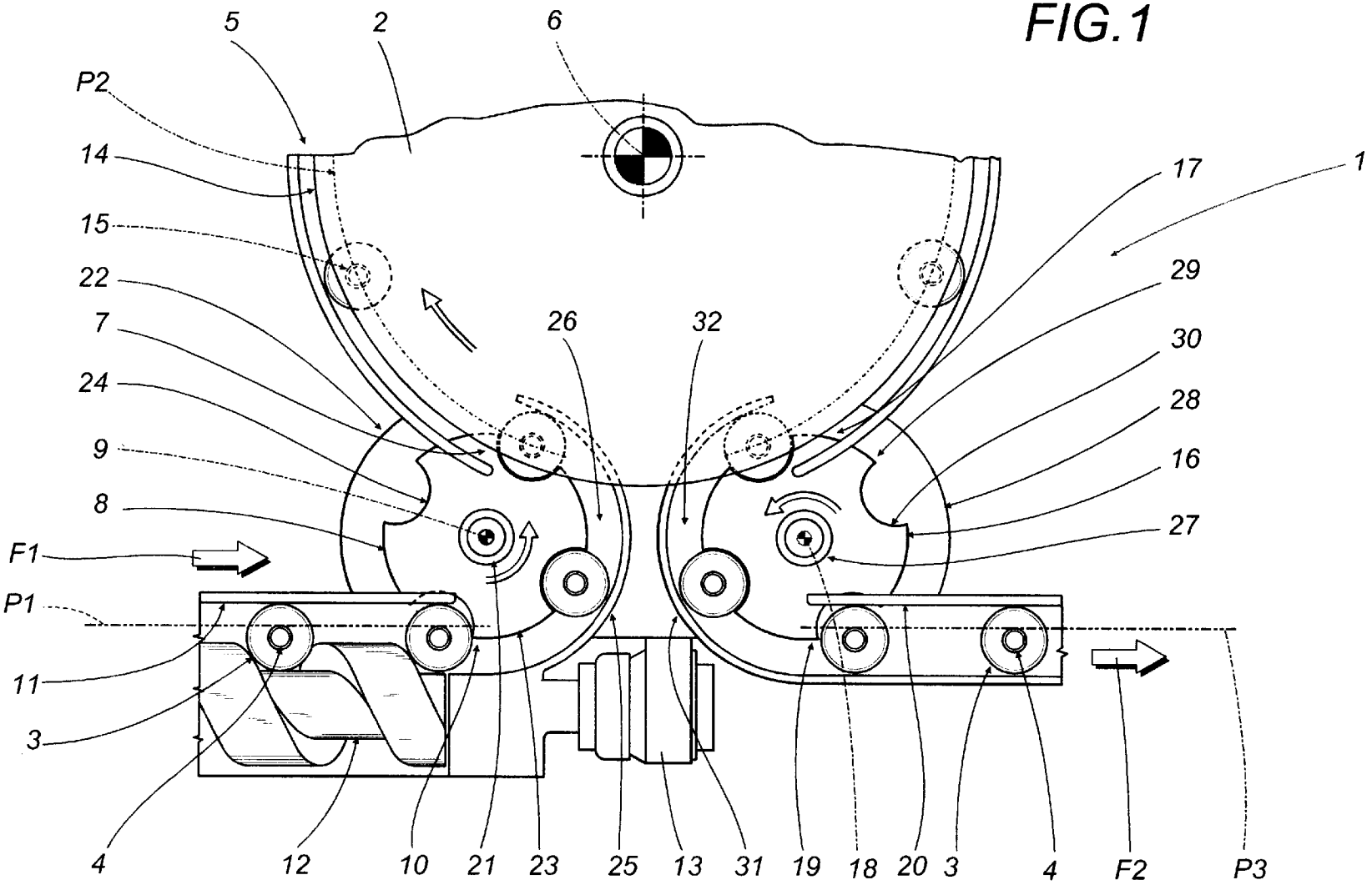
FIG. 1 illustrates a preferred embodiment of a portion of a filling machine equipped with a tank for dispensing liquid substances into containers, shown in a fragmentary schematic view with certain parts omitted.

Referring to FIG. 1 of the drawings, 1 denotes a portion of a filling machine, in its entirety, for dispensing liquid substances 2 of greater or lesser viscosity into containers 3 each of which affording a filler mouth 4.

The machine comprises a main carousel 5 rotatable about a vertical axis 6, revolving clockwise as seen in FIG. 1 and tangentially to a first transfer station 7 through which containers 3 are supplied to the carousel singly and succession by a rotary infeed conveyor 8. The infeed conveyor 8 rotates counterclockwise as seen in FIG. 1 about a vertical axis 9 parallel to the main axis 6, tangentially to a first infeed station 10 at which it receives a succession of containers 3 proceeding along a first predetermined path P1 afforded by a horizontally disposed infeed channel 11; the channel is equipped with a screw feeder 12 and a relative motor 13 by which the containers 3 are advanced intermittently toward the infeed station 10 along the first path P1 in a direction denoted F1. The carousel 5 is disposed and embodied in such a way as to support the containers 3 and serves also to carry a tank 14, rigidly associated with the carousel and furnished with a plurality of filler valves 15 equispaced about the vertical axis 6 of rotation. The filler valves 15 are designed in such a way that each will assume a position of alignment above the mouth 4 of a relative container 3 as the tank 14 rotates about the axis 6, propelled by the carousel 5, and thus allow a quantity of the liquid substance 2 contained in the tank to be dispensed into each of the single containers 3; the advancing containers 3 are made at the same time to follow a second predetermined feed path P2 extending around the axis 6 of rotation, along which the filling step will take place, and once filled are released to a rotary outfeed conveyor 16 by way of a second transfer station 17.

The outfeed conveyor 16 rotates counterclockwise as seen in FIG. 1 about a vertical axis 18 parallel to the axis 6 of the carousel and serves to direct the filled containers 3 from the second transfer station 17 through an outfeed station 19 and thence into an outfeed channel 20 aligned with the infeed channel 11, along which they advance in a direction denoted F2 following a third predetermined path P3 toward a pickup unit not indicated in the drawings.

The infeed conveyor 8 comprises a shaft 21 placed concentrically with the respective axis 9, carrying a platform 22 at the bottom, and at least one disc element 23 uppermost that consists in a star wheel of conventional embodiment, presenting an ordered succession of peripheral recesses 24 each partially accommodating a relative container 3 standing on the platform 22. The conveyor 8 also comprises an external fence 25 combining with the periphery of the star wheel 23 to define a respective channel 26 along which the containers 3 pass from the infeed station 10 to the first transfer station 7.

In similar fashion to the infeed conveyor 8, the outfeed conveyor 16 comprises a shaft 27 disposed concentrically with the relative axis 18, carrying a platform 28 at the bottom and at least one star wheel element 29 uppermost presenting an ordered succession of peripheral recesses 30 each partially accommodating a relative container 3 standing on the platform 28. The conveyor 8 also comprises an external fence 31 combining with the periphery of the star wheel 29 to define a respective channel 32 along which the containers 3 pass from the second transfer station 17 to the outfeed station 19.

Figure 2:
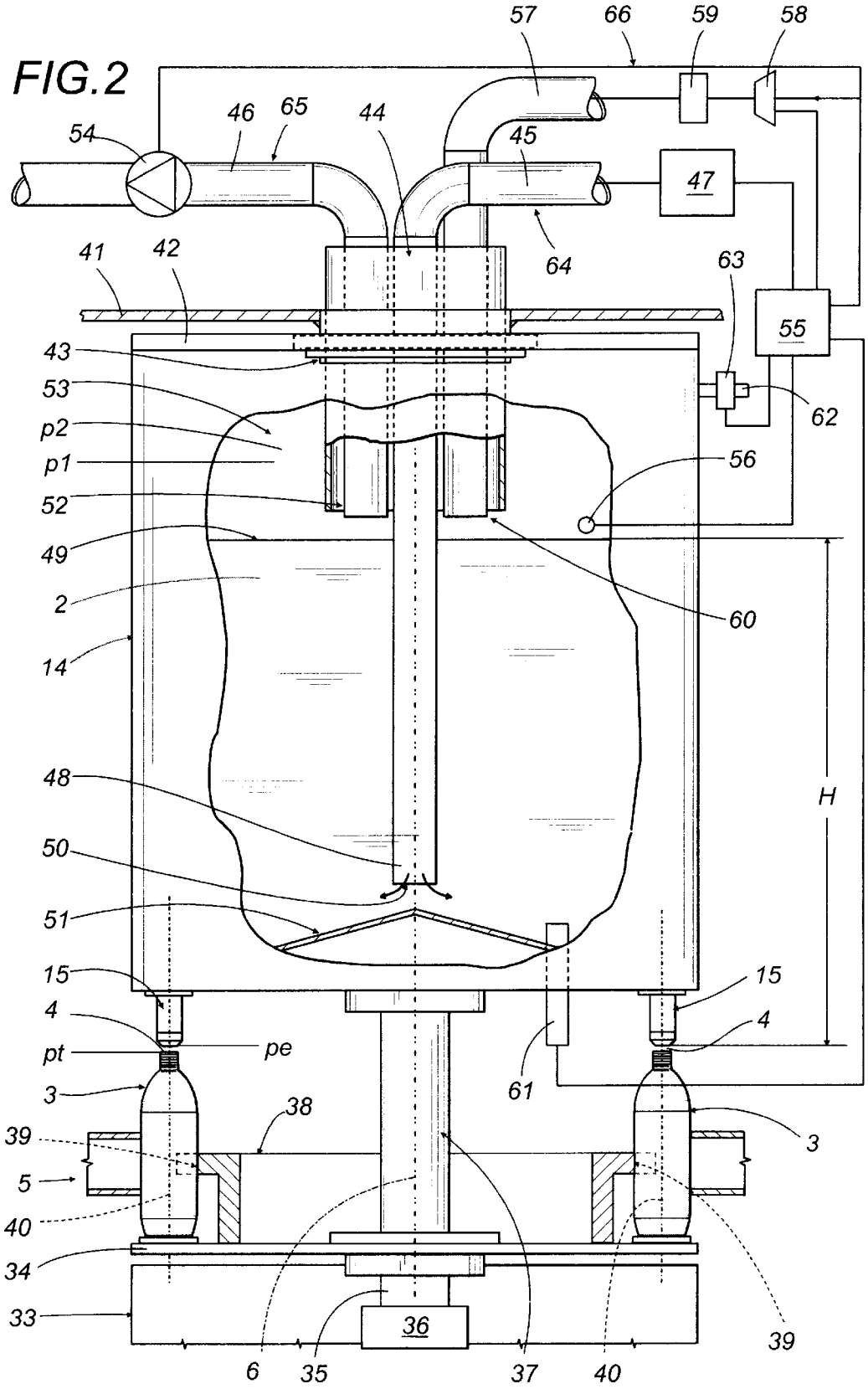
FIG. 2 illustrates a detail of FIG. 1, including the tank, in an elevation with parts cut away and parts shown in section.

As indicated in FIG. 2, the carousel 5 comprises a frame 33 supporting a motor 36 of conventional type indicated schematically by a block. The shaft 35 of the motor 36 is coupled to a shaft 37 concentric with the axis 6 of rotation and mounted rotatably to the frame 33. This same shaft 37 also carries a horizontally disposed circular flange 34, keyed to the end nearer the motor 36 and above the frame 33, the tank 14 being keyed to and supported by the end opposite.

The flange 34 functions as a platform on which to stand the containers 3 and carries a star wheel 38 concentric with the axis 6 of rotation, affording a succession of peripheral recesses 39 similar to the recesses 24 and 30 of the infeed and outfeed star wheels, with respective vertical axes 40 equispaced about the axis 6 of rotation, of which the movement is timed with that of these same recesses 24 and 30 during operation.

When the flange 34 star wheel 38 and shaft 37 are set in motion by the motor 36 and rotated about the axis 6 in a clockwise direction as seen in FIG. 1, moving along the second path P2, the tank 14 is caused likewise to rotate together with the filler valves 15 and the containers 3 currently aligned with each of the single valves 15. In effect, each of the recesses 39 is associated with a respective filler valve 15, which in turn is coaxially aligned with the respective axis 40.

Each filler valve 15 can be associated with the mouth 4 of a relative container 3 in such a way as to leave the interior of the container open to the surrounding atmosphere, at a pressure denoted pt. In other words, the filler valve 15 is not intended to create a seal with the mouth 4 of the respective container 3.

As discernible in FIG. 2, the tank 14 is supported at the top by a fixed flat structure 41 connected in conventional manner (not illustrated) to the frame 33. The structure 41 is connected to the top wall 42 of the tank 14, which functions as a lid, by way of a bearing 43 that allows the tank 14 to rotate about the main axis 6 relative to the fixed structure 41. The bearing 43 is concentric with the axis 6 of rotation and affords a hole accommodating a fixed sleeve 44. The sleeve 44 in turn supports an infeed duct 45 conveying the liquid substance 2 and terminating internally of the tank 14, also a vacuum duct 46 and a compressed air inlet duct 57, both of which terminating likewise internally of the tank 14.

The sleeve 44 is equipped with sealing means of conventional embodiment (not illustrated) serving both to ensure that the tank 14 remains fluid-tight and to create seals around the ducts 45, 46 and 57 aforementioned. Thus, when the tank 14 is set in rotation about the axis 6, the three ducts 45, 46 and 57 remain stationary, carried by the sleeve 44, and the bearing 43 rotates about the sleeve.

The infeed duct 45 is connected at one end in familiar manner to a source of the liquid substance 2, conventional in embodiment and represented by a block denoted 47 in FIG. 2, and terminates inside the tank 14 in a portion denoted 48.

The duct 45 along with the corresponding terminal portion 48 and the source 47 combine to establish feed means, denoted 64 in their entirety, by which the liquid substance 2 is directed into the tank 14 and the tank filled to the point of establishing a head of predetermined height H representing the difference in level between the free surface 49 of the liquid substance 2 and the filler valves 15.

The spout 50 afforded by the terminal portion 48 of the duct 45 remains below the free surface 49 of the liquid substance and is positioned near to the bottom 51 of the tank 14.

Still in FIG. 2, the vacuum duct 46 exhibits a portion located externally of the tank 14, fitted with a pump 54, and passes through the sleeve 44 to terminate internally of the tank 14 in a portion denoted 52; more exactly, the terminal portion 52 occupies a space 53 in the tank 14 situated above the free surface 49 of the liquid substance 2.

The duct 46 along with the corresponding terminal portion 52 and the pump 54 combine to establish vacuum means, denoted 65 in their entirety, such as will generate a negative pressure internally of the tank 14, and more exactly in the space denoted 53.

The air inlet duct 57 exhibits a portion located externally of the tank 14 that is connected to a compressor 58 by way of a non-return valve 59, and passes through the sleeve 44 to terminate inside the tank 14 in a portion denoted 60 which, more exactly, occupies the aforementioned space 53 in the tank 14 situated above the free surface 49 of the liquid substance 2.

The duct 57 and its terminal portion 60 together with the compressor 58 and the valve 59 combine to establish compression means, denoted 66 in their entirety, of which the function is to pressurize the tank 14, and more exactly the space denoted 53.

In the event that the liquid substance inside the tank 14 is a substance tending to generate foam, the pump 54 will extract air from the space 53 at a given rate of flow through the relative duct 46, and thus reduce pressure in this same space 53 to a predetermined value p1, lower than the atmospheric pressure pt at the mouth 4 of a single container 3. In this manner, the jet of the liquid substance 2 dispensed from the outlet of each filler valve 15 emerges at a predetermined discharge pressure of which the value pe is lower than that which would register at the filler valve 15 in a jet generated by the head H of the liquid substance 2 inside the tank in the event of the tank 14, or more exactly the space 53 above the head of liquid, not being depressurized by the vacuum means 65 but left at the same atmospheric pressure pt as registers at the mouth 4 of the container 3.

In short, the effect of depressurizing the inside of the tank 14 is to reduce the pressure of the jet discharged from the filler valve 15 to a value that is substantially the same as the actual pressure of the head H minus the value of the negative pressure generated in the space 53 above the liquid by the vacuum means 65. By virtue of the negative pressure generated inside the tank 14, accordingly, the jet of fluid dispensed from the filler valve 15 emerges at a discharge pressure pe determined by a virtual head having less force than the actual head H, and the level of the head H can therefore be maintained at as high a level as possible inside the tank 14.

With the energy of a liquid substance 2 dispensed from the tank 14 thus controlled and comparatively low, its impact on the bottom of the container 3 is correspondingly less violent, and the tendency to foam is minimized.

It will be seen that depressurizing the tank 14 gives two fundamental advantages: firstly, any foam forming on the free surface of the mass of liquid substance 2 directed into the tank will be able to dissolve spontaneously, and secondly, a relatively generous head H can be maintained, with the result that the mass of liquid substance remains in the tank for a relatively long duration, thus allowing a relatively lengthy period during which any foam produced in the course of filling up the tank can dissolve all but completely in spontaneous manner, without the penalizing condition of a comparatively high discharge pressure directly proportional to the head H.

In the example of FIG. 2, the source 47 of liquid and the pump 54 are connected to a monitoring and control unit indicated by a further block 55, of which the operation is interlocked to a pressure sensor 56 located in the tank 14, internally of the space 53 above the head H of liquid substance 2. The function of the sensor 56 is to monitor the pressure in the space 53 continuously and return a control signal in real time to the unit 55, which responds by causing the source 47 to maintain the head H at a predetermined level for as long as the containers 3 are being filled, and by piloting the pump 54 to regulate the rate of flow at which air is evacuated from the space 53 according to the pressure at which the jet of liquid dispensed from the filler valve 15 needs to be maintained.

It will be clear from the foregoing description, assuming the head H to be maintained at the highest predetermined value obtainable, that the discharge pressure pe of the jet dispensed from the filler valves 15 is dependent on the value of the negative pressure generated by the pump 54 in the space 53 above the head, and on the density of the liquid substance 2 occupying the tank 14.

In the event that the liquid substance occupying the tank 14 is a viscous fluid and, due to its consistency, less easily dispensed from the filler valves 15 than liquid substances of relatively low viscosity, a quantity of air will be directed by the compressor 58 through the non-return valve 59 and the duct 57 into the tank so as to raise the pressure in the space 53 above the head to a given value p2 higher than the atmospheric pressure pt registering at the mouth 4 of the container 3. In this way, the jet of the viscous substance 2 that issues from each filler valve 15 is dispensed at a predetermined discharge pressure pe higher than the pressure at which the jet would be delivered from the filler valve 15 if generated exclusively by the head 2 of liquid inside the tank in the event of the tank 14, or rather the space 53 above the head, not being pressurized by the compression means 66 but left at the same atmospheric pressure pt as registers at the mouth 4 of each container 3.

In short, the effect of pressurizing the inside of the tank 14 is to increase the pressure of the jet of fluid dispensed from the filler valve 15 to a value that will be substantially the same as the actual pressure of the head H plus the value of the pressure generated in the space 53 above the head by the compression means 66.

As a result of the pressure generated inside the tank 14, accordingly, the jet of viscous fluid is dispensed from the filler valve 15 at a discharge pressure pe determined by a virtual head of value greater than the actual head H. Consequently, the energy stored in the viscous substance 2 leaving the tank 14 is controlled, and relatively higher than that produced by a head H with no additional pressurization.

The tank 14 is also equipped with a vent duct 62 communicating with the space 53 above the head and fitted with a valve 63 that can be piloted by the control unit 55 to connect the space 53 with the surrounding atmosphere in such a way as to maintain the pressure p2 below a selected limit.

It will be observed that pressurizing the tank 14 gives two essential advantages: firstly, substances of appreciable viscosity can be dispensed from the filler valves 15 at a reasonably high rate of flow, and secondly, the head H can be maintained at a relatively low level, for example when the tank 14 is nearing depletion and the supply diminishing gradually. In practice, when the head H reduces to a relatively low level at which the gravitational hydrostatic pressure on the bottom 51 of the tank becomes insufficient to force the viscous substance through the filler valves 15 at an acceptably high rate of flow, the step of pressurizing the vacant space 53 afforded by the tank 14 has the effect of increasing gravity-related hydrostatic pressure on the bottom 51 of the tank 14 and thus forcing the viscous substance 2 through the filler valves 15 at the required rate of flow.

With this end in view, as indicated in FIG. 2, the compressor 58 is connected to the monitoring and control unit 55, and the unit interlocked in turn to a pressure sensor 61 located at the bottom 51 of the tank 14. The function of the sensor 61 is to monitor the gravitational pressure of the head H continuously and return a control signal in real to time to the unit 55, which responds by piloting the compressor 58 to meter the quantity of air directed into the space 53, and therefore the corresponding pressure value p2, according to the pressure pe at which the jet dispensed from the filler valve 15 needs to be maintained.

It will be clear that by adopting this expedient, the dimensions of the tank 14 can be made compact and the space occupied by the tank in the machine 1 thus minimized.

The vacuum means 65 and the compression means 66 can therefore be considered, in their entirety, as means by which to vary the pressure internally of the tank 14, of which the function is to modulate and control this same pressure according to the type of liquid or viscous substance handled and to the value of the discharge pressure pe required at the filler valves 15.

In operation, the tank 14 being filled with the liquid substance 2 and a given head H established, containers 3 are advanced singly and in succession along the infeed channel 11 by the screw feeder 12, spaced apart uniformly along the first path P1 and moving in the direction F1 that takes them toward the infeed station 10, where each one is taken up from the corresponding recess 24 of the conveyor 8 and transferred to a recess 39 of the carousel star wheel 38. Once located in the recess 39, the single container 3 is aligned with the respective axis 40 and positioned with the mouth 4 directly beneath a corresponding filler valve 15.

As the first container in line enters a relative recess 39, the carousel 5 and the tank 14 are set in rotation about the main axis 6 by the motor 36, in such a way that each successive container 3 is directed along the second path P2 and each filler valve 15 positioned above the mouth 4 of a relative container 3.

At the same time, the filler valves 15 are caused to open by control means of conventional embodiment (not illustrated) and the liquid substance 2 is dispensed into each container 3.

Prior to the step of opening the filler valves 15 and in the event that the liquid substance 2 is a foamable type, the vacuum pump 54 will be activated by the control unit 55 and begin extracting air from the space 53 above the liquid at a given rate of flow in such a way as to establish a selected negative pressure p in the tank 14.

As the liquid substance is directed into each of the containers 3, the control unit 55 will ensure that the source 47 continues to supply a quantity of liquid such as will maintain the head H in the tank, and, in conjunction with the sensor 56, that the pump 54 continues to depressurize the tank 14 and thus maintain the selected pressure p.

The containers 3 are thus filled as they advance along the second path P2 and toward the second station 17, where each one in turn is taken up by a corresponding recess 30 of the outfeed conveyor 16 and transferred to the outfeed station 19. At this point, the full containers 3 are directed into the outfeed channel 20 and caused to advance along the third path P3 in the direction F2 that distances them from the filling machine 1.

Likewise in the case of a viscous substance 2, the gravitational hydrostatic pressure registering at the bottom 51 of the tank 14 causes a signal to be sent from the relative sensor 61 to the control unit 55, which responds accordingly by piloting the compressor 58 to raise the pressure in the tank 14 to a value p2 higher than atmospheric. The higher pressure p2 is monitored continuously by the sensor denoted 56 in such a way as to obtain a discharge pressure at the filler valves 15 of which the value is directly proportional to the required flow rate. As the tank begins to empty, the head H gradually reduces and the compressor 58 responds by raising the pressure p2 gradually in the space 53 above and thus compensating the reduction in gravitational hydrostatic pressure on the bottom 51 of the tank.

What is claimed:

1. A method of dispensing liquid substances into containers, each container having a filler mouth, said method comprising:

directing a liquid substance into a tank affording a fluid-tight enclosure and equipped with at least one filler valve positionable in alignment with and over the filler mouth of the container;

filling the tank until the free surface of the liquid substance is separated from the filler valve by a head of predetermined height;

dispensing a quantity of the liquid substance from the tank into the container by way of the filler valve;

maintaining the filler mouth of the container in communication with the surrounding atmosphere;

depressurizing the tank and maintaining the tank at a pressure less than the atmospheric pressure registering at the filler mouth of the container.

2. A method as in claim 1, comprising the step, implemented simultaneously with the dispensing step, of maintaining the predetermined head of the liquid substance inside the tank and above the at least one filler valve at a constant value.

3. A method as in claim 1, wherein the head of the liquid substance is a maximum head obtainable inside the tank.

4. A method as in claim 1, wherein the liquid substance is directed into the tank at a pre-determined level below the free surface presented by the head of the liquid substance occupying the tank.

5. A method as in claim 1, wherein the step of depressurizing the tank is performed in such a way that the jet of the liquid substance dispensed from the outlet of the at least one filler valve will be delivered at a pre-determined discharge pressure of which the value is less than the pressure at which the jet would be dispensed from the outlet of the at least one valve if generated by the head of the liquid substance in the tank without the step of depressurizing the tank.

6. A method of dispensing liquid substances into containers, each container having a filler mouth, said method comprising:

advancing containers in ordered succession along a first predetermined path toward a first transfer station;

transferring the containers intermittently in ordered succession to a carousel, rotatable about a main axis, and supporting a tank that affords a fluid-tight enclosure and is equipped with a plurality of filler valves uniformly distributed about the axis of rotation;

directing a liquid substance into the tank and filling the tank sufficiently to establish a predetermined head between the free surface of the liquid substance and the filler valves;

setting the carousel and the tank in rotation about the axis in such a way that each filler valve is positioned in alignment with and over the mouth of a relative container and directed thus together with the container around a second predetermined path along which the containers are filled;

dispensing a quantity of the liquid substance from the tank into each container through the filler valves while maintaining the mouth of the container open to the surrounding atmosphere;

depressurizing the tank and maintaining the tank at a pressure less than the atmospheric pressure registering at the filler mouth of each container;

advancing the containers during the dispensing step along the second predetermined path toward a second transfer station from which the filled containers run out.

7. A tank for dispensing liquid substances into containers, each container having a filler mouth, said tank comprising:

feed means by which a liquid substance is supplied to the tank;

at least one filler valve located at the bottom of the tank such as can be associated with each container to be filled while leaving the filler mouth of each associated container open to the surrounding atmosphere, the tank being filled by the feed means until the free surface of the liquid substance is separated from the filler valve by a head of predetermined height;

pressure variation means disposed and embodied in such a way that the pressure within a fluid-tight enclosure afforded by the tank can be reduced to obtain a value below that of the atmospheric pressure registering at the filler mouth of the container.

8. A tank as in claim 7, wherein pressure variation means consist in vacuum means capable of depressurizing the interior of the tank to a predetermined value in such a way that the jet of the liquid substance dispensed from the outlet of the at least one filler valve will be delivered at a predetermined discharge pressure less than the pressure at which the jet would be dispensed from the outlet of the valve if generated by the head of the liquid substance in the tank without the aid of the vacuum depressurizing means.

9. A tank as in claim 8, comprising a monitoring and control unit, interlocked to a pressure sensor positioned internally of the tank and connected both to the feed means and to the vacuum means, such as will maintain the predetermined head at a constant level in the tank and above the at least one filler valve, while maintaining the pressure value obtained by depressurization substantially at a constant value.

10. A tank as in claim 9, wherein the head of the liquid substance is maintained by the monitoring and control unit at a maximum level obtainable internally of the tank.

11. A tank as in claim 7, wherein feed means by which the liquid substance is supplied to the tank terminates inside the tank in an outlet located below the free surface of the head of the liquid substance.

12. A tank as in claim 7, rotatable about a vertical axis and equipped with a plurality of filler valves distributed uniformly around the axis of rotation, each designed to associate with the mouth of a respective container.

13. A filling machine comprising a main carousel, rotatable about a vertical axis and carrying a tank as in claim 12, equipped with a plurality of filler valves, also a first transfer station by way of which containers are directed intermittently and in ordered succession onto the carousel, wherein the tank and the carousel are rotatable as one about the vertical axis and the filler valves each positionable over the mouth of a respective container in such a way as to dispense a quantity of the liquid substance into each container while advancing together with the containers along a predetermined feed path as the containers are filled and proceeding toward a second transfer station by way of which the filled containers are directed onto outfeed means.

* * * * *